US011713951B1

(12) United States Patent
McPherson

(10) Patent No.: US 11,713,951 B1
(45) **Date of Patent: *Aug. 1, 2023**

(54) COLLET BULLET-SEATING DIE

(71) Applicant: Michael Lee McPherson, Cortez, CO (US)

(72) Inventor: Michael Lee McPherson, Cortez, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,210

(22) Filed: May 10, 2022

Related U.S. Application Data

(63) Continuation of application No. 17/483,667, filed on Sep. 23, 2021, now Pat. No. 11,326,864.

(51) Int. Cl.
*F42B 33/10* (2006.01)
*F42B 33/00* (2006.01)

(52) U.S. Cl.
CPC ..... *F42B 33/10* (2013.01); *F42B 33/002* (2013.01); *F42B 33/005* (2013.01)

(58) Field of Classification Search
CPC .... F42B 33/002; F42B 33/004; F42B 33/005; F42B 33/10
USPC ..... 62/43; 86/43
See application file for complete search history.

(56) References Cited

U.S. PATENT DOCUMENTS

| | | | | |
|---|---|---|---|---|
| 2,700,915 | A | 2/1955 | Pattison | |
| 2,719,453 | A | 10/1955 | Bahler | |
| 3,204,518 | A | 9/1965 | Jackson | |
| 3,580,127 | A | 5/1971 | Lee | |
| 3,602,084 | A | 8/1971 | Corcoran | |
| 4,248,132 | A * | 2/1981 | Blomseth | F42B 35/02 86/24 |
| 4,336,739 | A * | 6/1982 | Alexander | F42B 33/001 86/24 |
| 4,836,078 | A | 6/1989 | Lee | |
| 4,862,567 | A | 9/1989 | Beebe | |
| 6,244,154 | B1 | 6/2001 | Beebe et al. | |
| 7,703,369 | B1 | 4/2010 | Lee | |
| 11,326,864 | B1 * | 5/2022 | McPherson | F42B 33/10 |
| 2002/0157524 | A1 | 10/2002 | Tuftee | |
| 2011/0083546 | A1 | 4/2011 | Palkowitsh | |
| 2022/0034637 | A1 | 2/2022 | Burke et al. | |

* cited by examiner

*Primary Examiner* — Bret Hayes
(74) *Attorney, Agent, or Firm* — Nasr Patent Law LLC; Faisal K. Abou-Nasr

(57) ABSTRACT

A bullet-seating die for precisely loading a bullet into a cartridge case is disclosed. In embodiments, the bullet die comprises: a die body; means for controlling seating depth of the bullet in the cartridge case; means for positively centering the bullet in the die body; means for positively centering a front end and base of the cartridge case in the die body; means for seating the bullet by engaging an ogival portion of the bullet that will engage a rifling as the bullet moves into a bore when a loaded cartridge is fired; and means for releasing the seated bullet from the seating means.

2 Claims, 1 Drawing Sheet

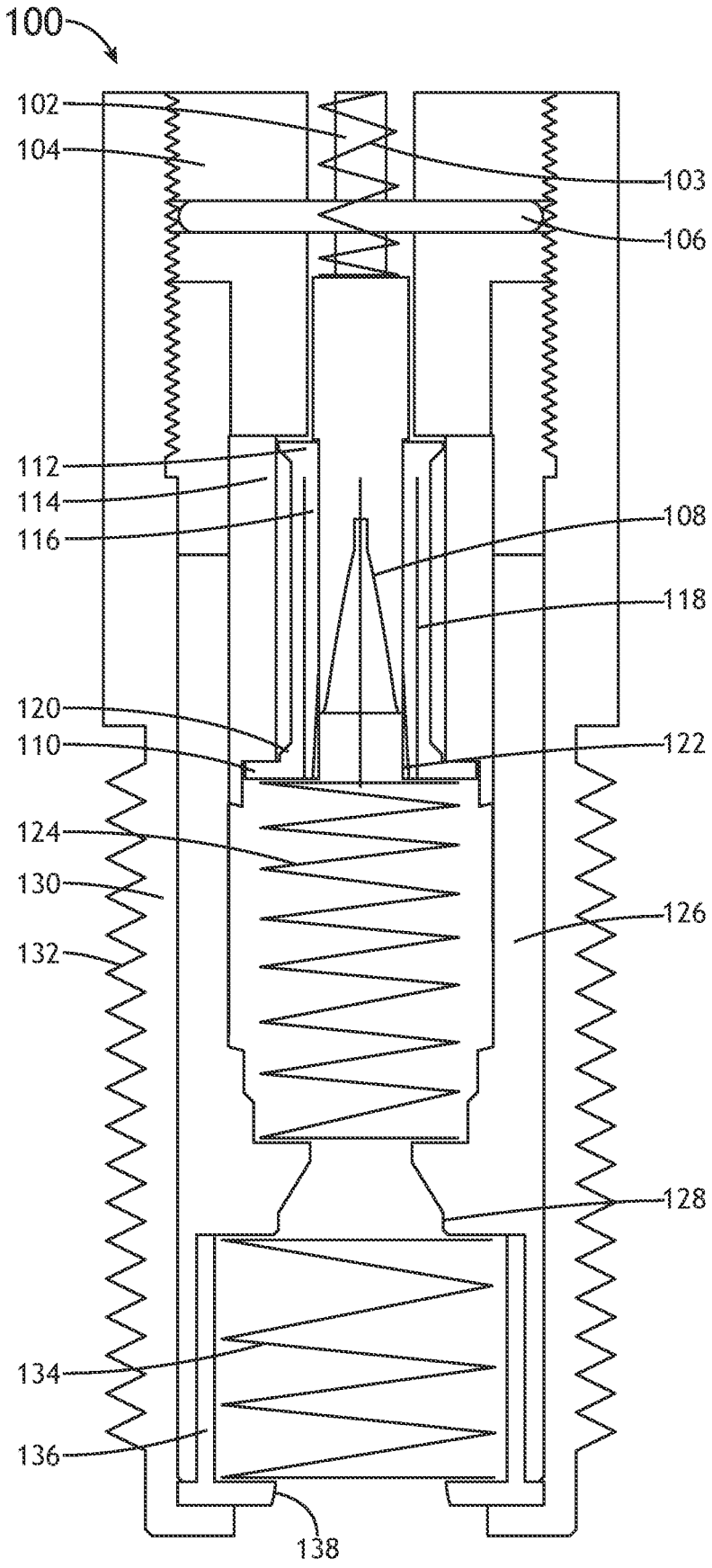
100
102
104
103
106
112
114
116
108
118
120
110
122
124
130
126
132
128
134
136
138

COLLET BULLET-SEATING DIE

CROSS-REFERENCE TO RELATED APPLICATIONS

The present application is a continuation of U.S. Non-provisional application Ser. No. 17/483,667, filed Sep. 23, 2021, and titled "COLLET BULLET-SEATING DIE," which is incorporated herein by reference in its entirety.

TECHNICAL FIELD

The present disclosure relates to precision cartridge loading, and in particular to bullet-seating dies.

BACKGROUND

Relevant Definitions

In precision cartridge loading, the following terms are generally recognized:

Barrel Time: Time it takes the bullet to traverse the bore as the round fires, beginning at some prescribed event, such as the instant the sear releases the striker;

Barrel Vibrations: Unavoidable barrel vibrations as the bullet traverses the bore;

Bore: Rifled portion of a gun barrel;

Bottlenecked Case: A cartridge case design having a distinct section where case diameter increases from neck diameter to body diameter;

Bullet: Portion of the cartridge that produces from the bore of the barrel as the round fires;

Bullet Seating: Physical process of forcing a bullet into the neck of a case with an interference fit, the inside of the neck was smaller than bullet diameter;

Bullet-to-Rifling Jump: Distance the bullet in a chambered round must move before it engages the lands of rifling in the barrel;

Cartridge: A complete round of ammunition, containing a primer, propellant, and a bullet within a case;

Cartridge Case: Device used to contain the other components of a cartridge;

Case Base: Portion of cartridge case near the head of the case, end opposite the neck;

Case Neck: Portion of a cartridge case that holds the bullet in the loaded round;

Case Shoulder: Portion of a bottlenecked cartridge between the smaller case neck and the larger case body, sometimes the shoulder is minimal in width and sometimes no shoulder exists, but the case rearward of the neck simply begins to taper so the case of the case body is larger than the neck;

Leade: That portion of the rifling that engages and engraves into the perimeter of the bullet, as necessary to impart spin to the fired bullet;

Loading Press: Tool that holds the bullet-seating die and provides a mechanical means of forcing the bullet and case into the bullet-seating die, and for removing the loaded cartridge from the die;

Primer: Device used to ignite the propellant of a cartridge;

Propellant: Energetic material that self-combusts to release gas and heat, thereby providing the force to drive the bullet from the case, into, and through the barrel;

Rifling: Portion of a barrel that imparts rotation to a bullet as that is driven through the bore as the cartridge is fired;

Runout: Misalignment between the longitudinal axes of the bullet and case in a loaded cartridge;

Seating Die: Device used in conjunction with a loading press for bullet seating; and Tapered Case: A cartridge case design lacking a shoulder, instead behind the neck the case merely begins to enlarge in diameter with what is usually a shallow taper angle toward the case head.

Limitations of Existing Systems:

For maximizing accuracy of loads using modern pointed bullets and many other bullet designs, the problem with all bullet-seating dies has always been the same: The die does not engage the portion of the bullet that engraves into the rifling.

For various reasons, this creates a situation where the seated bullets will have different bullet-to-rifling jump distances when the loaded rounds are chambered. These variations in bullet-to-rifling jump distance result in shot-to-shot variations in barrel vibrations and shot-to-shot variations in the time it takes the bullets to pass through the bore. These variations result in a reduction of accuracy within any set of shots using otherwise nominally identical cartridges.

Ideally, the bullet-seating die should engage the bullet along the portion of the ogive that engages the rifling and will thereby minimize variation in bullet-to-rifling jump among a batch of cartridges that have been loaded using the same components and die adjustments.

Historically, the problem with such a die design is that the bullet-seating device always traps the bullet during the seating operation. Then, as the loaded cartridge is removed from the die, the seating device simply pulls the bullet back out of the case. This is a mechanical issue having to do with the angles involved and the coefficient of friction of the materials used.

This result is essentially unavoidable without incorporating special design features into the seating device or some means of driving the bullet out of the die after seating, so the seating device does not pull on the bullet as the loaded round is removed from the die.

SUMMARY

This disclosure presents a bullet-seating die that overcomes the limitations of existing systems that have been discussed above. In this regard, a bullet-seating die for precisely loading a bullet into a cartridge case is disclosed. In embodiments, the bullet-seating die comprises: a die body having a top end and a bottom end; a bullet-nose-alignment stem extending into the die body from the top end, the bullet-nose-alignment stem being configured to engage and center a front end of the bullet within the die body before bullet-seating begins and configured so it is precisely centered in the die body; a bullet-seating-depth-adjustment screw, configured to be threaded into the top of the die body and adjusted to control seating depth of the bullet in the cartridge case; a bullet-seating collet, configured to surround an ogival portion of the bullet that will engage a rifling when a loaded cartridge is fired; a bullet-seating collet bushing disposed beneath the bullet-seating-depth-adjustment screw, the bullet-seating collet bushing being configured to positively center the bullet-seating collet in the die body; a case-shoulder-alignment bushing, configured to positively center a front end of the cartridge case along an axis of the die body, and further configured to positively center the bullet-nose-alignment stem, the bullet-seating collet bushing, and the bullet seating collet along the axis of the die body during bullet seating; and a case-base-alignment bushing, configured to positively center the base of the cartridge case in the case-shoulder-alignment bushing, thereby positively aligning the base of the cartridge case with the die body during bullet seating.

More generally, embodiments of the bullet-seating die may comprise a die body with any currently existing or later discovered means for controlling seating depth of the bullet in the cartridge case; means for positively centering the bullet nose and base in the die body; means for positively centering a front end and base of the cartridge case in the die body; means for seating the bullet by engaging an ogival portion of the bullet that will engage a rifling as the bullet moves into a bore when a loaded cartridge is fired; and means for releasing the seated bullet from the bullet-seating collet or other seating means.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWING

The detailed description is described with reference to the accompanying FIGURES. The use of the same reference numbers in different instances in the description and the FIGURES may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

FIG. 1 is a cross-sectional view of a bullet-seating die, in accordance with an example embodiment of this disclosure.

DETAILED DESCRIPTION

Reference will now be made in detail to the subject matter disclosed, which is illustrated in the accompanying drawing.

Overview:

As previously discussed, ideally, a bullet-seating die should engage a bullet along the portion of the bullet ogive that engages the rifling and will thereby minimize variation in bullet-to-rifling jump among a batch of cartridges that have been loaded using the same components and die adjustments.

Two means of accomplishing the goal of releasing the bullet are disclosed. Modification of the seating device is a simpler and otherwise superior approach. However, both of the disclosed approaches accomplish the same goal, albeit through different mechanisms.

One method would involve a modification to the bullet-seating die, to incorporate some means of driving the seated bullet from the seating device, and thereby removing the loaded cartridge (sometimes referred to as the "loaded round") from the bullet-seating die. For example, using a separate plunger that engaged the end of the bullet ogive after the tool that drove the case and bullet into the die had been removed, so the loaded round could freely separate from the die, with force applied only to the front end of bullet.

The preferred method is to alter the seating device. This modified seating device would, similarly, engage the bullet along the length where the bullet engages the rifling. The engagement surface would be tapered to match the angle of the leade in the barrel, or at an otherwise idealized angle, or radiused to match the design of the bullet surface along that portion that would engrave into the rifling, or otherwise designed to engage a length of the ogive sufficient to prevent bullet damage during bullet seating. Then, the portion of the seating device that engages the bullet and a section above that is cut into several sections, endwise, thereby creating a collet.

The bore of this collet is sized, to perfectly fit the bullet, as described above, and the exterior is sized to perfectly fit into a collet support guide (collar) that prevents the collet from expanding at all when the necessary bullet-seating force pushes the collet and the sleeve upward. The collet and collet collar have corresponding surfaces that engage so that the collar prevents the collet from moving beyond a specific height in the bullet-seating die and so that the collet cannot expand laterally when fully raised in the collar.

Then, when the force pushing the case upward is released and the round is withdrawn from the die, the collet moves downward with only modest spring pressure resisting that movement, and separately from the collar, until the collet is no longer constrained against enlarging in diameter. When this happens, the collet fingers can expand laterally and freely release the bullet. Therefore, no force of sufficient magnitude ever occurs that would pull the bullet back out of the case neck.

Additional features that are more or less important to the functionality and usefulness of the disclosed bullet-seating die include: Micrometer seating depth adjustment, possibly with detents, and increments of ½-thousandth or 1-thousandth inch; Preliminary bullet alignment stem that engages the bullet near the tip, to assure full alignment of bullet with die before seating begins; Case alignment sleeve designed to engage the case body immediately behind the case shoulder only, to prevent the case shoulder from elastically expanding during bullet seating (a characteristic that will increase load-to-load variation in bullet to rifling jump); Precision fitment of parts, to assure that both bullet and case are centered precisely and aligned with the axis of the case and die as seating occurs; TiN (or other friction-proofing and protective) plating on working parts (possibly all parts), to minimize friction and thereby assure maximum repeatability in bullet-to-rifling jump and to minimize lateral deflection of bullet tip during seating, and to eliminate corrosion; and Alternative seating collets matched to the ogive of the bullet the customer is using.

The inventors claim that this basic mechanism of seating a bullet will provide a significant reduction in round-to-round variation in bullet-to-rifling jump in the loaded ammunition, regardless of the means of achieving this goal. Through extensive experimentation, the inventors have demonstrated that constraining variations in bullet-to-rifling jump is hypercritical to ammunition accuracy; this aspect is far more important than many other factors that have heretofore been identified and controlled. Further, these seating die designs are the only feasible means of minimizing variations in bullet-to-rifling jump that do not involve multiple seating die adjustments followed by repeated seating steps for each load in each batch of ammunition. While this can be done, it is simply not feasible for normal ammunition loading; also, it will, unavoidably, introduce variations in the finished ammunition that will degrade accuracy.

The inventors also claim that by including two high-precision, sliding, spring-loaded, case alignment bodies in the bullet-seating die, the bullet-seating die will also assure superior case alignment and centering within the die body during bullet seating, which will help minimize bullet runout (misalignment between the longitudinal axes of the bullet and case) in the loaded cartridge. And, by having separate case alignment bodies, the top one, which engages the case, only immediately behind the junction of the case shoulder and the case body, this system will also minimize elastic deformation of the case shoulder during bullet seating, which will further reduce variations in bullet-to-rifling jump in the loaded cartridges.

Therefore, this disclosure is directed to three inventive aspects that all work toward maximizing accuracy of the loaded cartridge:

1. A Collet seating system that engages the bullet only in the section where the bullet engraves into the rifling;
2. A case support and alignment bushing that engages and supports the case immediately behind the shoulder; and
3. A case alignment bushing the engages the case toward the bottom (rear) of the case body The collet seating device, and the additional design features are intended to maximize precision and to minimize any possibility of the bullet-seating die introducing runout into the loaded round, or damage or deformation to the bullet or case during the bullet seating process. In every way, the design goal of this die is to provide ideal, uniform bullet seating, and to do so as perfectly as is feasible.

Example Embodiments

FIG. 1 illustrates an example embodiment of a bullet-seating die 100 for precisely loading a bullet into a cartridge case. (Top end of die body 130, top of seating depth adjustment screw 104, and various other die parts not shown in FIG. 1).

The bullet-seating die 100 includes a die body 130 having a top end and a bottom end. In embodiments, the die body 130 may be precision machined. The die body 130 may include a threaded portion 132 for securing the die body 130 within a loading press. The die body 130 may further include a threaded lock ring to locate the die body 130 in the press by engaging the threaded portion 132 on the outside of the die body 130 that attaches the die body 130 to the loading press.

The bullet-seating die 100 further includes a bullet-nose-alignment stem 102 extending into the die body 130 from the top end. The bullet-nose-alignment stem 102 is configured to engage and center the front end of the bullet within the die body 130 before bullet seating begins and as bullet seating progresses, and to center in the seating collet 116. For example, the bullet-nose-alignment stem 102 may include an ogival socket 108 configured to support the front end (i.e., tip) of the bullet in the die body 130 before the bullet seating process begins and as the bullet seating process progresses. The neck of the cartridge case centers the base of the bullet in the die body 130 before the bullet seating begins and as bullet seating progresses. In this manner, the front end and base of the bullet are initially centered and aligned with the cartridge case and remain centered during the seating process. The bullet and cartridge are further aligned during the bullet seating process by various mechanisms that are described below. A portion of the bullet-nose-alignment stem 102 may be surrounded and/or acted upon by a bullet-nose-alignment stem spring 103 that is configured to push the bullet-nose-alignment stem 102 downward in die body 130 when the bullet-nose-alignment stem spring 103 is relaxed.

A bullet-seating-depth-adjustment screw 104 is configured to be threaded into the top of the die body 130 and adjusted to control seating depth of the bullet in the loaded cartridge case. This controls the final seating depth after completing the bullet seating process, thereby determines cartridge overall length and bullet-to-rifling jump, the latter being the distance the bullet must move when the loaded cartridge fires, before the bullet ogive engages the rifling of the bore.

The bullet-seating-depth-adjustment screw 104 is configured to be adjusted down or up in the die body 130 by turning the bullet-seating-depth-adjustment screw 104 clockwise or counterclockwise, respectively, relative to the die body 130. In embodiments, the bullet-seating-depth-adjustment screw 104 and die body 130 may be marked to provide precise and repeatable micrometer adjustments of bullet-seating depth.

The bullet-seating-depth-adjustment screw 104 may have an O-ring 106 disposed about a portion of the bullet-seating-depth-adjustment screw 104. The O-ring 106 is configured to provide friction between the bullet-seating-depth-adjustment screw 104 and the die body 130, to prevent inadvertent changes to user-selected and controlled bullet-seating depth.

The bullet-seating die 100 further includes a bullet-seating collet 116 and a bullet-seating collet bushing 114. The bullet-seating collet 116 is configured to surround an ogival portion of the bullet that will engage the rifling (i.e., the portion of the bullet ogive nearest the front of the full-diameter portion of the bullet). The bullet-seating collet bushing 114 is disposed beneath the bullet-seating-depth-adjustment screw 104. The bullet-seating collet bushing 114 is configured to positively center the bullet-seating collet 116 in the die body 130, thereby (along with the primary bullet-nose-alignment stem 102) positively centering the bullet within the die body 130 and positively aligning the axis (i.e., central axis) of the bullet to the axis (i.e., central axis) of the die body 130.

In embodiments, the bullet-seating collet 116 includes a tapered portion 122 configured to engage the ogival portion of the bullet. The tapered portion 122 of the bullet-seating collet 116 conforms to the curvature of the ogival portion of the bullet, along a portion of the bullet that engages the rifling, as the bullet moves into the bore when the loaded cartridge is fired. Such engagement location along the bullet ogive is critical to achieving the desired goal of keeping the bullet-to-rifling jump of all loaded rounds in any given batch of same-lot cartridges as nearly identical as is possible, which is equally critical to cartridge-to-cartridge repeatability of the lot of ammunition, which is equally critical to the resulting accuracy of that lot of ammunition.

The bullet-seating collet 116 further include some number (typically four to six) of axial cuts 118 that allow a diameter of a base of the bullet-seating collet 116 to increase when the bullet-seating collet 116 is pulled out from the bottom of the bullet-seating collet bushing 114, thereby freely releasing the loaded bullet from the bullet-seating collet 116 after the bullet-seating is completed, as the case-shell holder mechanically withdraws the loaded round from the bullet-seating die.

The bullet-seating collet 116 includes a top alignment section 112 at a top end of the bullet-seating collet 116, to positively center the top end of the bullet-seating collet 116 in the die body 130, progressively, through the bullet-seating collet bushing 114 and the case-shoulder-alignment bushing 126. The bullet-seating collet 116 further includes a bottom alignment section 120, configured to positively center a bottom end of the bullet-seating collet 116 in the bullet-seating collet bushing 114 and further configured to prevent the bullet-seating collet 116 from expanding during bullet seating, when the bullet-seating collet 116 is pushed upward into the bullet-seating collet bushing 114.

In embodiments, the bullet-seating collet 116 also includes a travel-limiting section 110 (i.e., an outdented or flared portion just below the bottom alignment section 120) configured to engage the bullet-seating collet bushing 114 and to thereby limit upward movement of the bullet-seating collet 116 in the die body 130, as controlled by the bullet-seating-depth-adjustment screw 104 limiting upward travel of the bullet-seating collet bushing 114 within the die body 130.

The bullet-seating die 100 further includes a case-shoulder-alignment bushing 126 that surrounds at least a portion of the bullet-seating collet bushing 114. The case-shoulder-alignment bushing 126 is configured to positively center a front end (top) of the cartridge case along the axis of the die body 130, and is further configured to positively center the bullet-nose-alignment stem 102, the bullet-seating collet bushing 114, and case-base-alignment bushing 136 along the axis of the die body 130 during bullet seating, thereby (along with the primary bullet-nose-alignment stem) positively centering the bullet within the die body 130 and positively aligning the axis of the bullet to the axis of the die body 130.

The case-shoulder-alignment bushing 126 is configured to precisely and positively support that portion of the cartridge case body immediately rearward of the junction of the case shoulder (or neck, in those instances of a tapered case lacking a neck) and case body, against elastic or inelastic expansion of the case body during bullet seating, as a result of the downward force applied to the case neck as the bullet-seating collet 116 forces the bullet into the case neck, which pushes the inside of the case shoulder rearward and thereby bends the case shoulder and pushes the case body, at the shoulder-to-body junction, outward, such expansion being a variable that can contribute to variation in bullet-to-rifling jump in the finished cartridge and therefore being detrimental to precise control of bullet-to-rifling jump.

The case-shoulder alignment bushing 126 includes a case-shoulder alignment section 128 (i.e., a form-fitting annular section) configured to positively center and support the cartridge case just rearward of the shoulder to body junction and thereby center the front end of the cartridge case within the die body 130 during bullet seating. The case-shoulder alignment section 128 is configured to support the front end of the cartridge case (either behind the shoulder in a bottlenecked case or the neck in a tapered case) against deformation during bullet seating.

A case-shoulder alignment bushing spring 124 may be at least partially nested within the case-shoulder alignment bushing 126. In embodiments, the case-shoulder alignment bushing spring 124 is configured to push the bullet-seating collet 116 upward in the die body 130 when the bullet-seating die 100 is relaxed and during bullet seating, and further configured to push the case-shoulder-alignment bushing 126 downward in the die body 130, when the bullet-seating die 100 is relaxed and before the cartridge case enters the die body 130 sufficiently to force the case-shoulder alignment bushing 126 upward in the die body 130.

The bullet-seating die 100 further includes a case-base-alignment bushing 136 at least partially nested within the case-shoulder-alignment bushing 126 and located at the bottom end of the die body 130. The case-base-alignment bushing 136 is configured to positively center a base of the cartridge case in the case-shoulder-alignment bushing 126, thereby positively aligning the base of the cartridge case with the die body 130 during bullet seating. Combined, the case-shoulder-alignment bushing 126 and the case-base-alignment bushing 136 work together to positively center the cartridge case in and align the cartridge case with the axis of the die body 130 during bullet seating. The case-base-alignment bushing 136 includes a case-base-alignment section 138, a form-fitting annular section) configured to positively center a base of the cartridge case in the die body 130 during bullet seating.

A case-base-alignment bushing spring 134 may be at least partially nested within the case-base-alignment bushing 136. In embodiments, the case-base-alignment bushing spring 134 is configured to push the case-base-alignment bushing 136 downward in the die body 130 when the bullet-seating die 100 is relaxed and then downward against a perimeter of the cartridge case, near the base of the cartridge case, as the cartridge case enters sufficiently far into the die body 130 to engage the case-base-alignment bushing 136 during bullet seating.

The bullet-seating die 100 is configured to control alignment of the bullet and the cartridge case with each other during and after the bullet seating operation, and wherein the bullet-seating die 100 is further configured to control the seating depth of the bullet so that bullet-to-rifling jump is identical or nearly identical from one loaded cartridge to the next.

All of the bullet-seating die 100 components may be machined to a high degree of precision, as needed to assure a high degree of precision in centering and alignment of the case and bullet within the die body 130 and relative to each other.

In alternative embodiments, the bullet-seating die 100 may include any other means of releasing the seated bullet from any type of seating device that seats the bullet using an ogival portion of the bullet that will engage the rifling as the bullet moves into the bore as the loaded cartridge fires. For example, any device that forces the bullet-nose alignment stem 102 (or any similar feature) downward, to drive the bullet free from the seating device (i.e., bullet-seating collet 116 or any functionally equivalent tool that seats the bullet by engaging that portion of the bullet that will engage the rifling as the bullet moves into the bore).

In alternative embodiments, the bullet-seating die 100 may include any other means of positively centering both the front end and base of the cartridge case in the die body 130, and thereby positively aligning the cartridge case with the die body 130 during bullet seating.

In alternative embodiments, the bullet-seating die 100 may include any other means of positively centering both the front end and base of the bullet within the die body 130, and thereby positively aligning the axis of the bullet with the axis of the die body 130 during bullet seating.

In alternative embodiments, the bullet-seating die 100 may include any other means of positively engaging the bullet along that portion of the ogive that will engage the rifling as the round is fired, to minimize variations in bullet to rifling jump.

In alternative embodiments, the bullet-seating die 100 may include any other means of positively preventing significant deformation of the case shoulder during bullet seating, to minimize variations in bullet to rifling jump.

The totality of the bullet-seating die 100 structure, in the embodiments described herein, is directed to perfecting alignment of the bullet and case with each other during and after bullet seating and perfecting seating depth of the bullet so that bullet-to-rifling jump is as nearly identical from one cartridge to the next through the mechanisms described above or through any other functionally similar means or by any means that achieve the same goals.

Although the invention has been described with reference to embodiments illustrated in the attached drawings, equivalents or substitutions may be employed without departing from the scope of the invention as recited in the claims. Components illustrated and described herein are examples of devices and components that may be used to implement embodiments of the present invention and may be replaced with other devices and components without departing from the scope of the invention. Furthermore, any dimensions, degrees, and/or numerical ranges provided herein are to be understood as non-limiting examples unless otherwise specified in the claims.

What is claimed is:

1. A bullet-seating die, for precisely loading a bullet into a cartridge case, comprising:

a die body;

means for controlling seating depth of the bullet in the cartridge case;

means for positively centering the bullet in the die body;

means for positively centering a front end and base of the cartridge case in the die body;

means for seating the bullet by engaging an ogival portion of the bullet that will engage a rifling as the bullet moves into a bore when a loaded cartridge is fired; and means for releasing the seated bullet from the seating means.

2. The bullet-seating die of claim 1, wherein the bullet-seating die is configured to control alignment of the bullet and the cartridge case with each other during bullet seating, and wherein the bullet-seating die is further configured to control the seating depth of the bullet so that bullet-to-rifling jump is identical or nearly identical from one loaded cartridge case to the next.

* * * * *